US005489160A

United States Patent [19]

Patrick et al.

[11] Patent Number: 5,489,160

[45] Date of Patent: Feb. 6, 1996

[54] PRINT MEDIUM SUPPORT MECHANISM FOR INK-JET PRINTERS

[75] Inventors: Jeffrey G. Patrick; Steve O. Rasmussen, both of Vancouver, Wash.

[73] Assignee: Hewlett-Packard Company, Palo Alto, Calif.

[21] Appl. No.: 396,189

[22] Filed: Feb. 28, 1995

[51] Int. Cl.[6] ..... B41J 13/26

[52] U.S. Cl. ..... 400/642; 400/600; 400/603.1

[58] Field of Search ..... 400/600, 600.4, 400/603, 603.1, 642, 647, 647.1; 271/209

[56] References Cited

U.S. PATENT DOCUMENTS

| | | | |
|---|---|---|---|
| 4,728,963 | 3/1988 | Rasmussen et al. | 271/209 |
| 4,815,876 | 3/1989 | Kobayashi et al. | 400/603.1 |
| 5,194,904 | 3/1993 | Ruch | 271/209 |
| 5,209,466 | 5/1993 | Watts et al. | 271/209 |
| 5,280,897 | 1/1994 | Maekawa | 271/209 |
| 5,356,229 | 10/1994 | Hickman et al. | 400/642 |
| 5,393,151 | 2/1995 | Martin et al. . | |
| 5,419,644 | 5/1995 | Martin et al. | 400/642 |

OTHER PUBLICATIONS

HP Patent Application, S/N 08/057,364, Filed on Apr. 30, 1993 "Combined Central And Lateral Hold–Down Plates, And End–Of–Page Advance–Distance Decrease, In Liquid–Ink Printers".

HP Patent Application, S/N 08/056,229, File Apr. 30, 1993, "Imporved Media Control At Ink–Jet Print Zone".

*Primary Examiner*—John S. Hilten

[57] ABSTRACT

Described herein is a print medium support mechanism for supporting a print medium such as paper in a print zone adjacent a printer's printhead. The print medium support mechanism includes at least one drive roller positioned upstream from the print zone of the printer to feed paper into the print zone. An upper print media guide is positioned adjacent the drive roller between the drive roller and the print zone to contact and support the paper from above. A lower print media guide is mounted downstream from the upper print media guide to pivot between retracted and non-retracted positions relative to the print zone. When in its non-retracted position, the lower print media guide contacts and supports the paper from below. The support of the upper and lower print media guides against opposite sides of the paper is primarily responsible for establishing the shape and angle of the paper as it passes through the print zone. The print medium support mechanism includes a pivot stop which is adjustable to set the vertical position of the lower print media guide relative to the upper print media guide when the lower print media guide is pivoted to its non-retracted position. This effectively establishes a desired print medium shape and angle. A separate media-to-printhead spacing adjustment mechanism is provided for adjusting the vertical positioning of the printer's printhead relative to the paper. Because of this, the media-to-printhead spacing can be set without affecting the settings made to obtain the optimal print medium shape and angle.

20 Claims, 6 Drawing Sheets

PRINT MEDIUM SUPPORT MECHANISM FOR INK-JET PRINTERS

FIELD OF THE INVENTION

This invention relates to a paper or print medium support mechanism for supporting a print medium adjacent a printer's printhead in the printer's print zone.

BACKGROUND OF THE INVENTION

FIGS. 1 and 2 show an example of a prior art print medium support mechanism 20 and associated printhead 22. These example components are like those of the "DESKJET 560C" color ink-jet printer, manufactured by the Vancouver, Wash., Division of Hewlett-Packard Company. Print medium support mechanism 20 comprises, generally, a plurality of drive rollers or drive roller tires 24 distributed laterally across the width of a paper path. Drive rollers 24 are mounted on a roller shaft 26 which extends laterally across the paper path. For illustration purposes, a partial sheet of paper 28 is shown entering the print medium support mechanism beneath drive rollers 24. The paper is held against rollers 24 by pinch rollers, not shown, and by an upper print media guide 30. The paper wraps upward and around the rollers, and exits the support mechanism at the top of the rollers after making an approximately 180° turn.

Printhead 22 comprises, generally, a carriage 34, a color cartridge 36, and a black cartridge 38. It has a number of nozzles (not shown) which are directed downwardly to deposit ink droplets on paper 28. The printhead is supported at a fixed elevation by a carriage rod (not shown). The printhead is designed to repeatedly traverse the lateral width of the underlying paper, while print medium support mechanism 20 feeds the paper longitudinally beneath the printhead.

The nozzles of printhead 22 are aligned longitudinally over the paper for a length along the paper path of approximately ⅙ of an inch. The area beneath the nozzles covered by a single lateral traverse of the printhead is referred to as a "print zone." To optimize print quality, it is desirable to keep the paper at a very specific distance from the nozzles as it travels through the print zone. If the paper is too far from the nozzles, accuracy and print quality will suffer. If the paper is too near to the nozzles, the paper may contact the nozzles and smear the applied ink. Paper positioning is complicated in ink-jet printers by the tendency of paper to buckle or bow when wet ink is applied.

Printers have print medium support mechanisms for correctly positioning paper relative to printheads. With economical manufacturing tolerances, however, it is sometimes difficult to maintain precisely the correct media-to-printhead spacing from printer to printer. Accordingly, print medium support mechanisms often have mechanical adjustments for establishing a desired printer-to-printhead spacing for a particular printer. These adjustments might be set during or immediately after manufacture, or by the ultimate user of the printer after purchase.

In print medium support mechanism 20 of FIGS. 1 and 2, paper positioning is accomplished by what is referred to as a pivot, generally referenced by the numeral 40. Pivot 40 is mounted to roller shaft 26 and pivots thereabout between retracted and non-retracted positions. Pivot 40 is shown in its non-retracted position in each of FIGS. 1 and 2. In this position, pivot 40 has a lower print media guide or guide surface 42 upon which paper 28 rests as it travels through the print zone beneath printhead 22. During printing, pivot 40 is in the non-retracted position to support paper 28 as shown. Pivot 40 retracts (in a clockwise direction as viewed in FIG. 2), thereby lowering guide surface 42, as a new sheet of paper is fed into the mechanism. Pivot 40 is also retracted as a printed sheet is ejected into an output tray. Components of a clutch 44 are shown in FIGS. 1 and 2. Clutch 44 performs the function of retracting pivot 40 at appropriate times under the control of operating logic which will not be discussed here.

Guide surface 42 extends laterally across the paper path, beneath a lower support edge of upper print media guide 30. The vertical position of this upper surface determines the vertical position of paper 28 and, therefore, the distance or spacing between paper 28 and the nozzles of printhead 22. In order to optimize this spacing and to account for manufacturing tolerances, an adjustable stop is provided in print medium support mechanism 20 for limiting the rotation of pivot 40 toward its non-retracted position and, consequently, the upward movement of guide surface 42. This stop in effect defines the non-retracted position of pivot 40 and of guide surface 42. The stop in the mechanism of FIGS. 1 and 2 comprises a finger 46 (FIG. 2) which extends inward from upper print media guide 40 and which hits a tab 50 on clutch 44 when the pivot is rotated toward its non-retracted position. Since pivot 40 rotates with clutch 44, tab 50 limits the rotation of pivot 40 and therefore establishes the orientation of pivot 40 and the vertical elevation of guide surface 42 when the pivot is not retracted. The finger can be manually adjusted to vary the point at which it hits tab 50, thereby establishing the non-retracted elevation of guide surface 42. This adjustment is normally performed during manufacture of a printer to attain a desired paper elevation while also maintaining a specified minimum gap between guide surface 42 and the upper print media guide 30. The specified minimum gap is just large enough to allow passage of the thickest contemplated print medium, such as perhaps an envelope.

The support mechanism described above is designed to support paper through a print zone of about ⅙ of an inch. Newer printer designs, however, seek to incorporate printheads with longer print zones such as ½ an inch or more. Longer print zones are desirable to increase printing speeds. However, it is much more difficult to maintain precise paper positioning along a print zone of this length. Adding to this difficulty is the tendency of paper to bulge or curve upwardly (toward the printhead) in areas where ink is applied. This tendency is much more dramatic with long print zones, in which the potential area of ink application is much larger. Any significant bulge, however, will cause the paper to hit the printhead nozzles, thus smearing the ink. Moving the paper away from the printhead to avoid this interference decreases nozzle accuracy and reduces the overall print quality. It would be desirable to control the paper in such a way as to eliminate or at least drastically reduce its tendency to buckle or bulge. This degree of control has not been attained in the past.

SUMMARY OF THE INVENTION

The invention reduces the tendency for paper to buckle by using upper and lower print media guides of a printer to aggressively control the shape and angle of the paper as it extends through the printer's print zone. More specifically, the upper and lower print media guides are vertically adjustable relative to each other to establish the desired print medium shape and angle independently of media-to-printhead spacing. A separate and independent adjustment is provided for media-to-printhead spacing so that the optimal media-to-printhead spacing can be achieved without disturbing the optimal print medium shape and angle. Furthermore, the adjustment of the upper and lower print media guides and of the media-to-printhead spacing can be accomplished by automated equipment during product manufacture.

DESCRIPTION OF THE INVENTION

Figure 1:
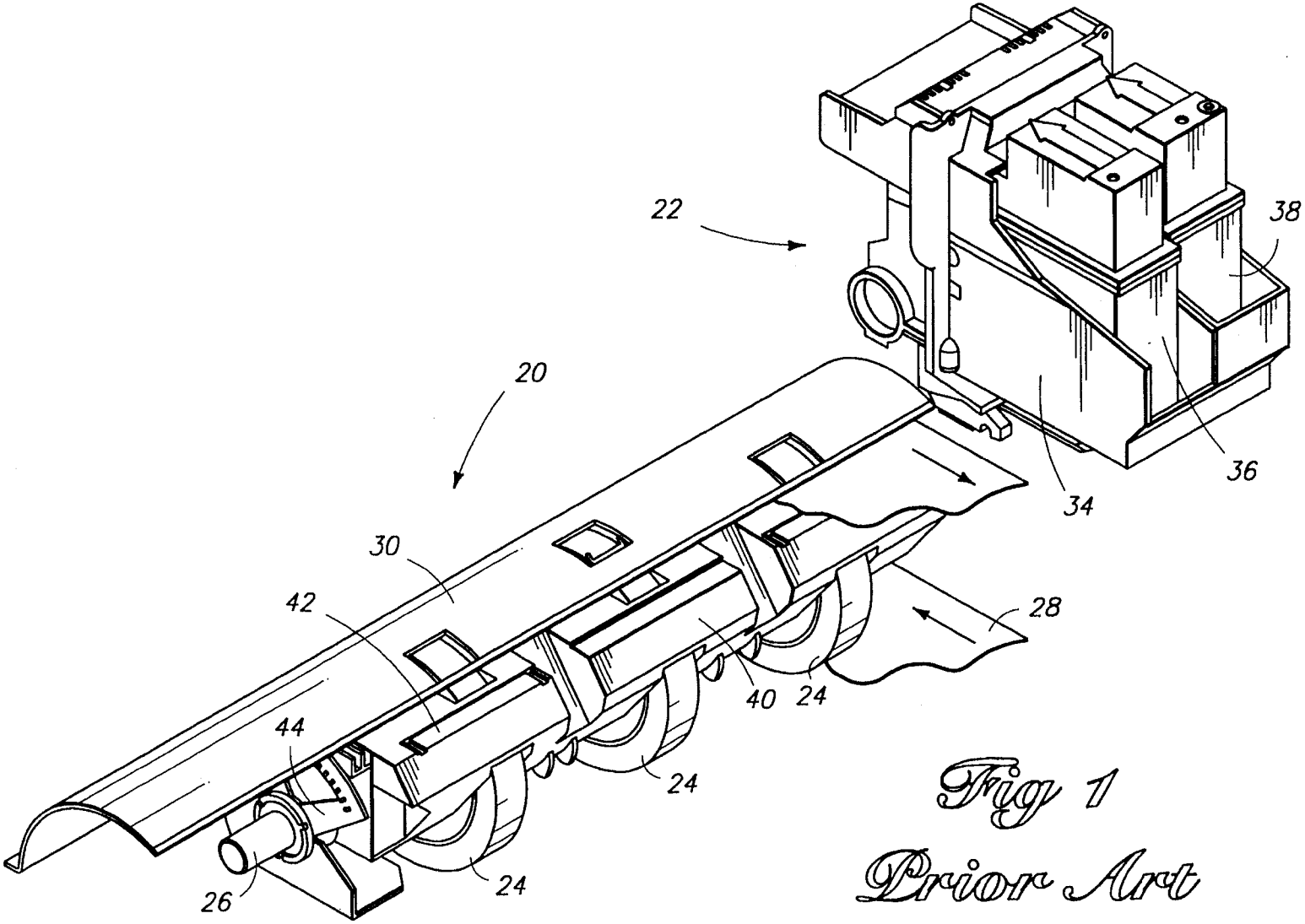
Fig 1 Prior Art
FIG. 1 is a diagrammatic top perspective view of a prior art print medium support mechanism and associated printhead.

FIGS. 3–7 show a print medium support mechanism 100 in accordance with a preferred embodiment of the invention for supporting paper in a printer's print zone adjacent a printhead 102. It should be noted that although this specification repeatedly refers to "paper" and "paper" print media, the components described are also used to support other types of sheetlike media such as mylar, envelopes, transparencies, cardboard, etc. Therefore, the term "paper" should be interpreted broadly to include such other types of sheet-like or paper-like media. It is also noted that further details regarding paper handling and print medium support mechanisms can be gleaned from other pending U.S. patent applications assigned to Hewlett-Packard Company including an application entitled "Print Medium Handling System Including Cockle Ribs to Control Pen-To-Print Medium Spacing During Printing," filed Feb. 28, 1994; and another application entitled "Media Handling in an Ink-Jet Printer," filed concurrently with this application, both of which are hereby incorporated by reference.

Print medium support mechanism 100 and printhead 102 are mounted to a carriage plate 104 which has been broken away as necessary in the drawings to show the components discussed below. Carriage plate 104 is adapted to mount the components within a particular printer (not shown).

Printhead 102 is a color ink-jet printhead having a carriage 103 which supports a color cartridge 106 and a black cartridge 108. Each cartridge has a plurality of nozzles (not shown) which are directed downwardly to deposit ink droplets on an underlying sheet of paper 110. The printhead is supported vertically by a carriage rod 111. In operation, print medium support mechanism 100 feeds paper 110 along a longitudinal paper path beneath the printhead while the printhead repeatedly traverses the lateral width of the underlying paper, and while print medium support mechanism 100 feeds the paper longitudinally beneath the printhead. Printhead 102 has a print zone as labeled in FIGS. 5 and 6 (extending between the dashed vertical lines). In the preferred embodiment, the print zone is approximately ½ inch in length.

The general function of print medium support mechanism 100 is to feed paper 110 along an upstream to downstream longitudinal print medium path while also supporting paper 110 in the print zone adjacent printhead 102. To this end, print medium support mechanism 100 comprises a plurality of drive rollers or drive roller tires 114 distributed laterally across the width of the paper path. Drive rollers 114 are mounted on a roller shaft 116 which has a longitudinal axis extending laterally across the width of the paper path, perpendicular to the direction of the paper path. Paper 110 enters the print medium support mechanism beneath drive rollers 114. The paper wraps upward and around the rollers, and exits the support mechanism at the top of the rollers after making an approximately 180° turn. Drive rollers 114 are driven through roller shaft 116 to rotate about the longitudinal axis of roller shaft 116. The drive rollers are mounted and positioned upstream of the print zone to feed paper into the print zone.

An upper print media guide 118 extends across the paper path upstream of the print zone, between the print zone and the rollers. Upper print media guide 118 includes an inner surface 120 (FIG. 4) which inclines or slopes downwardly from horizontal in the downstream direction of the paper path. Inner surface 120 terminates in a lower support edge 122 (FIGS. 3 and 4) which contacts and supports paper 110 from above.

Print medium support mechanism 100 includes a pivot 124 which is mounted to pivot or rotate around roller shaft 116. Pivot 124 forms a lower print media guide 126 downstream from the upper print media guide. Lower print media guide 126 includes an upper surface 128 (labeled in FIG. 4) which inclines or slopes upwardly in the downstream paper direction at an adjustable angle from horizontal to an upper support edge 130 which contacts and supports paper 110 from below. Lower print media guide 126 pivots with pivot 124 relative to the print zone between a non-retracted position (shown), and a retracted position (not shown). When retracted, lower print media guide 126 is in a lowered position, away from paper 110. In the non-retracted position, lower print media guide 126 contacts and supports paper 110 from below.

Figure 2:
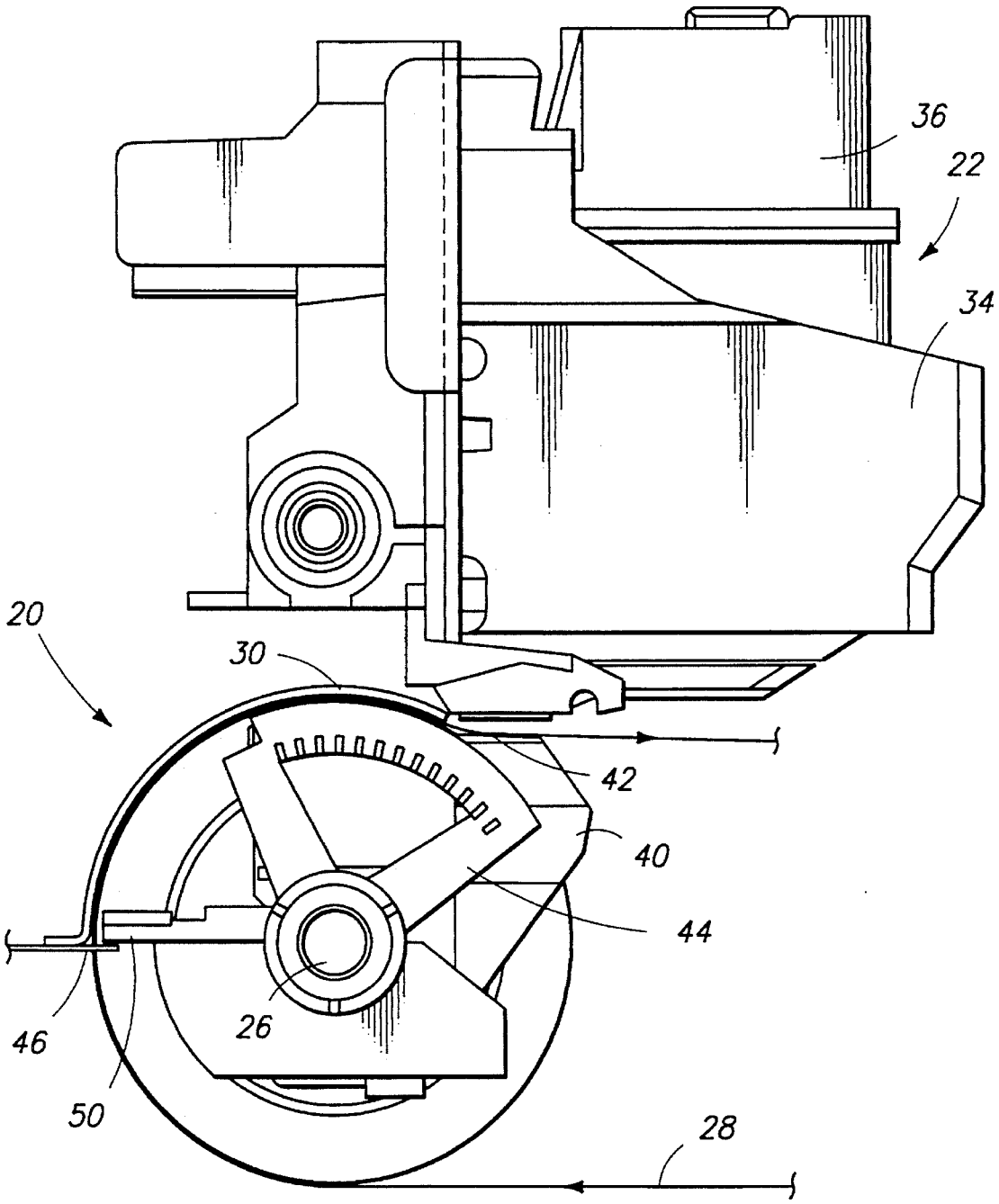
Fig 2 Prior Art
FIG. 2 is a diagrammatic side view of the prior art print medium support mechanism and printhead shown in FIG. 1.
Figure 3:
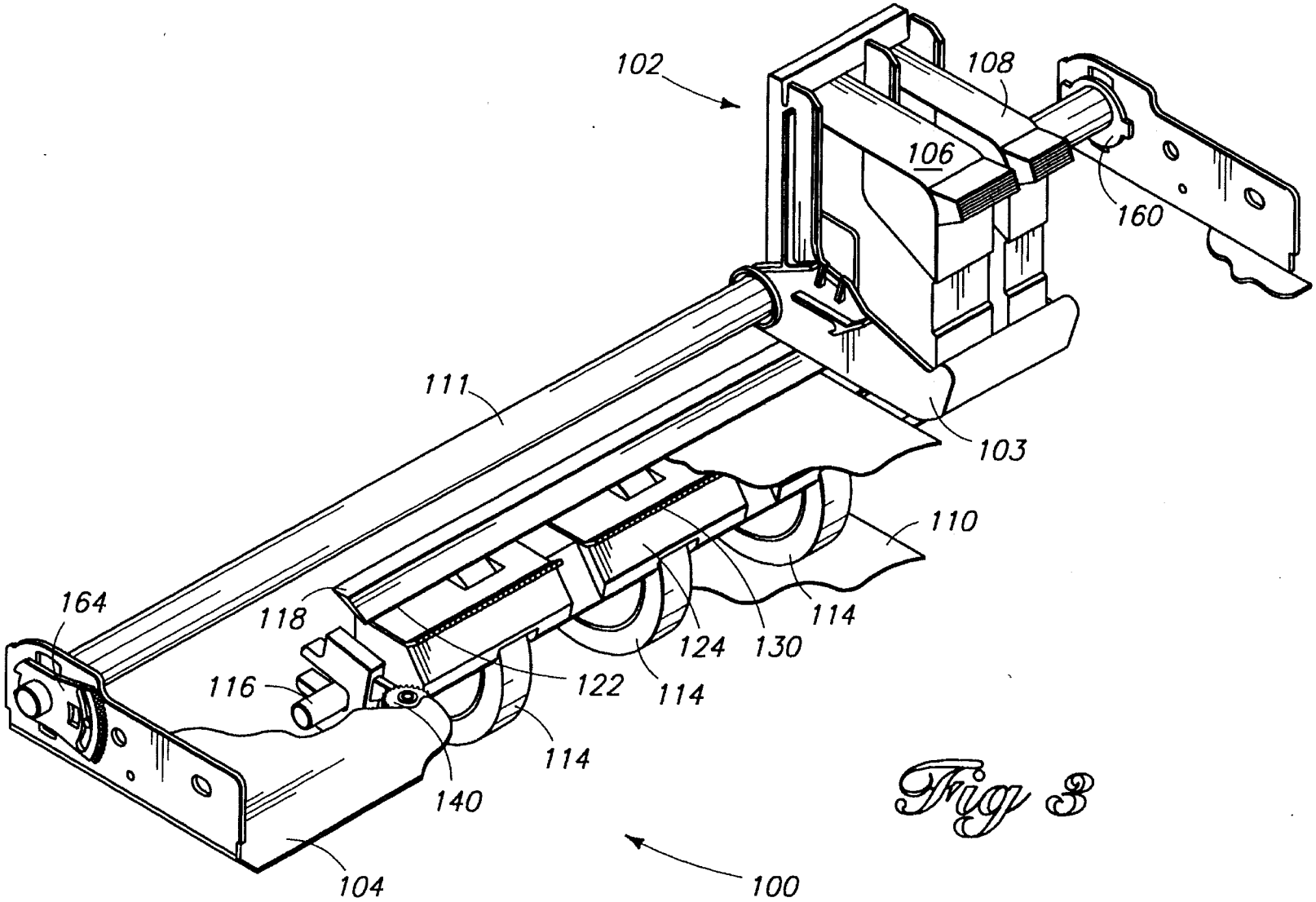
FIG. 3 is a diagrammatic top perspective view of a print medium support mechanism and associated printhead in accordance with a preferred embodiment of the invention.
Figure 4:
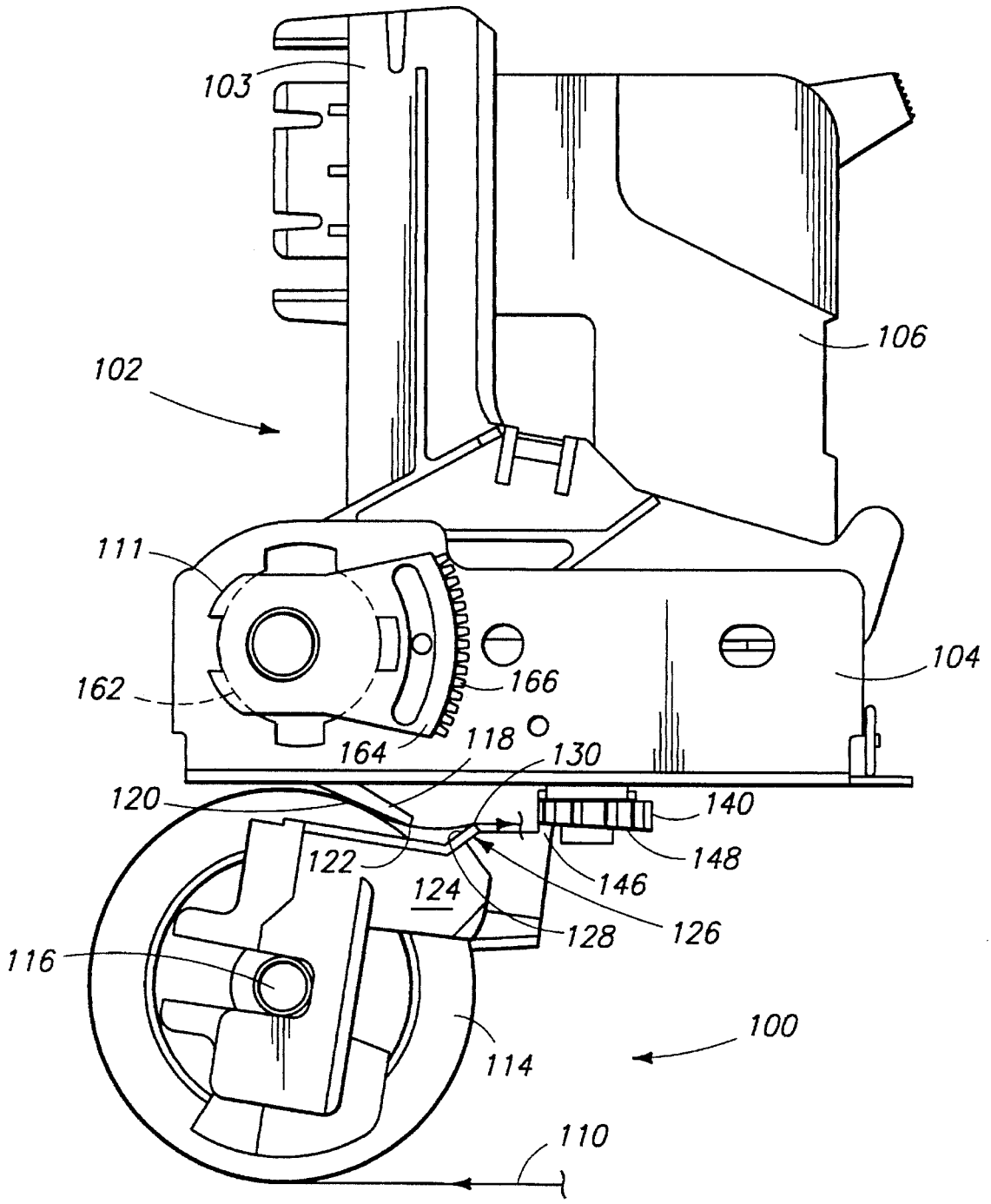
FIG. 4 is a diagrammatic side view of the print medium support mechanism shown in FIG. 3.

When pivot 124 is not retracted, drive rollers 114, lower support edge 122, and upper support edge 130 work in combination to tension and control the elevation and orientation of paper 110 as it passes through the print zone. To accomplish this, both lower support edge 122 and upper support edge 130 are below the uppermost elevation of the drive rollers. Furthermore, upper support edge 130 is desirably slightly higher than lower support edge 122. This forces paper 110 through first a downward path from driver roller 114 to lower support edge 122, and then a slightly upward path from lower support edge 122 to upper support edge 130. Specifically, the upper support edge is adjustable to an elevation above that of the upper print media guide lower support edge to incline the print medium upwardly in the downstream direction through the print zone. This is in contrast to the prior art mechanism shown in FIGS. 1 and 2 in which the lower guide surface must be kept at an elevation below the upper print media guide to produce a minimum gap for the print medium to pass through. Controlling the bending or bowing of the paper through the print zone in this manner reduces the tendency for it to buckle after high-density ink application.

To allow adjustment of lower support edge 122, print medium support mechanism includes a lower print media guide stop or pivot stop which pivot 124 rests against when it is rotated to its non-retracted position. The pivot stop is adjustable to set the vertical position of lower print media guide 126 relative to upper print media guide 118 when the lower print media guide is pivoted to its non-retracted position and to thereby set or establish the desired print medium shape and angle. In the preferred embodiment, the pivot stop comprises a moveable cam 140 of varying thickness. Cam 140 is preferably a rotatable stop wheel or cam wheel mounted beneath carriage plate 104. An abutment 146 extends from pivot 124 to contact cam wheel 140 when pivot 124 is not retracted. Cam wheel 140 is rotatably mounted to carriage plate 104 from above. Cam wheel 140 has a lower surface 148 which, because of the thickness variation of the wheel, varies in elevation at the point of contact between itself and abutment 146. The thickness of the cam wheel or the vertical elevation of its lower surface at the point where it is contacted by abutment 146 establishes the vertical position of lower print media guide 126. Cam wheel 140 can be turned to vary the elevation of its lower surface at the contact point and to thereby adjust the vertical position of lower print media guide 126. Cam wheel 140 is manufactured with a thickness variation of approximately one millimeter to allow vertical adjustment at lower support edge 122 by approximately 0.7 millimeters. As a further feature, cam wheel 140 has gear teeth 150 about its outer periphery to allow automated adjustment of the lower print media guide non-retracted positioning during manufacture of the print medium support mechanism.

Paper 110 has a shape and angle in the print zone which is established at least in part by the support of the upper and lower print media guides against the opposite sides of the paper. The cam wheel adjustment described above is used to provide the optimum relationship between lower support edge 122 and upper support edge 130 after assembly of a printer, and to thereby establish an optimum or desired print medium shape and angle through the printer's print zone. Print medium shape and angle is determined during adjustment by measuring the shape of a piece of paper as it passes through the print zone. Specifically, a laser measurement device is used to measure paper elevation at five different points along through the print zone. The points are preferably chosen directly over upper support edge 130 and at 2 and 4 millimeters upstream and downstream of upper support edge 130. A straight line is fit to these points and used to represent the average paper orientation and elevation, In response to these measurements, cam wheel 140 is adjusted to provide the desired print medium orientation. In the preferred embodiment, the cam wheel is adjusted so that the average paper angle under the print zone is approximately 0.25° from horizontal (sloping upwardly in the downstream direction), plus or minus 2°.

Once the desired print medium shape and angle is established, media-to-printhead spacing is established through an independent mechanism. Specifically, carriage rod 111 is mounted to carriage plate 104 with a pair of eccentric bushings 160 at either end of carriage rod 111. Bushings 160 have outer diameters which fit for rotation within and about the center of corresponding holes 162 in carriage plate 104. Carriage rod 111 is mounted within the bushings, with its central axis slightly behind the centers of holes 162. Rotating the bushings raises or lowers carriage rod 111 and, as a result, carriage 103. End plates 164 are attached to the bushings to facilitate rotating the bushings. End plates 164 have gear teeth 166 for engagement by an external mechanism for adjusting the height of carriage 103. The carriage rod and associated eccentric bushings form media-to-printhead spacing adjustment means for adjusting the vertical positioning of the printer's printhead relative to the upper and lower print media guides and for thereby setting the printhead at a desired spacing from the paper without changing the print medium shape and angle already established by the adjustment of the pivot stop. In the preferred embodiment, the mechanism is adjusted to obtain a nominal 0.055 inch media-to-printhead spacing.

Figure 5:
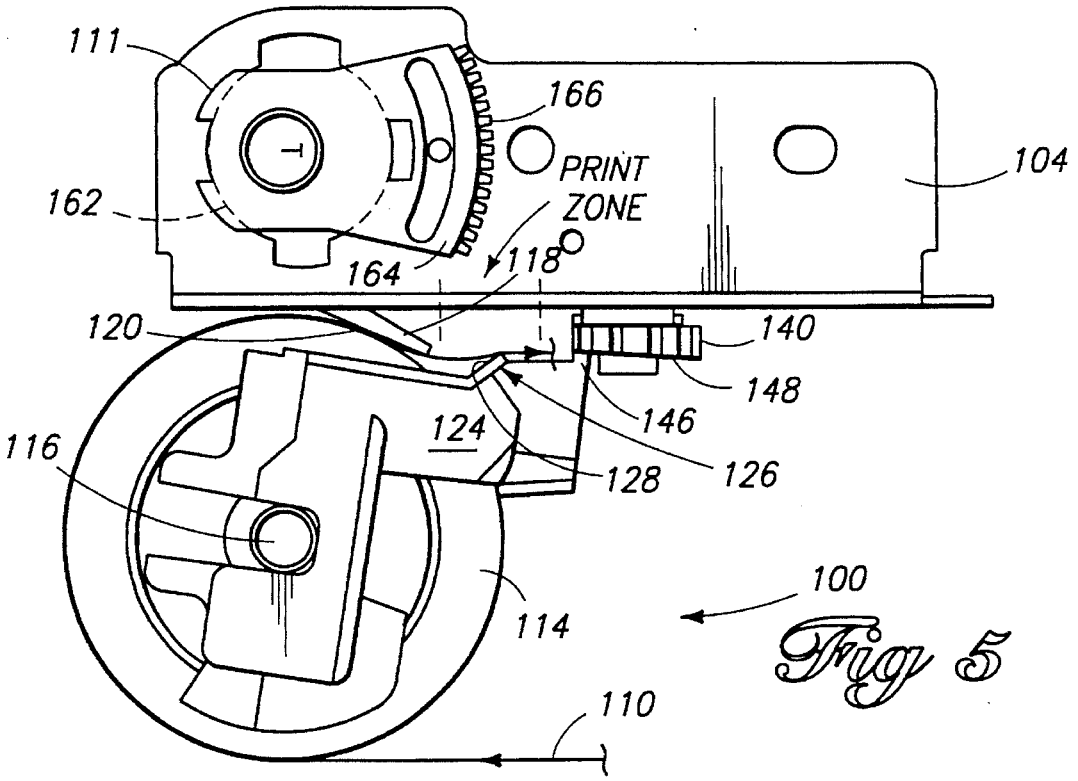
FIG. 5 is an enlarged diagrammatic side view of the print medium support mechanism shown in FIG. 3 configured in a first adjusted setting.
Figure 6:
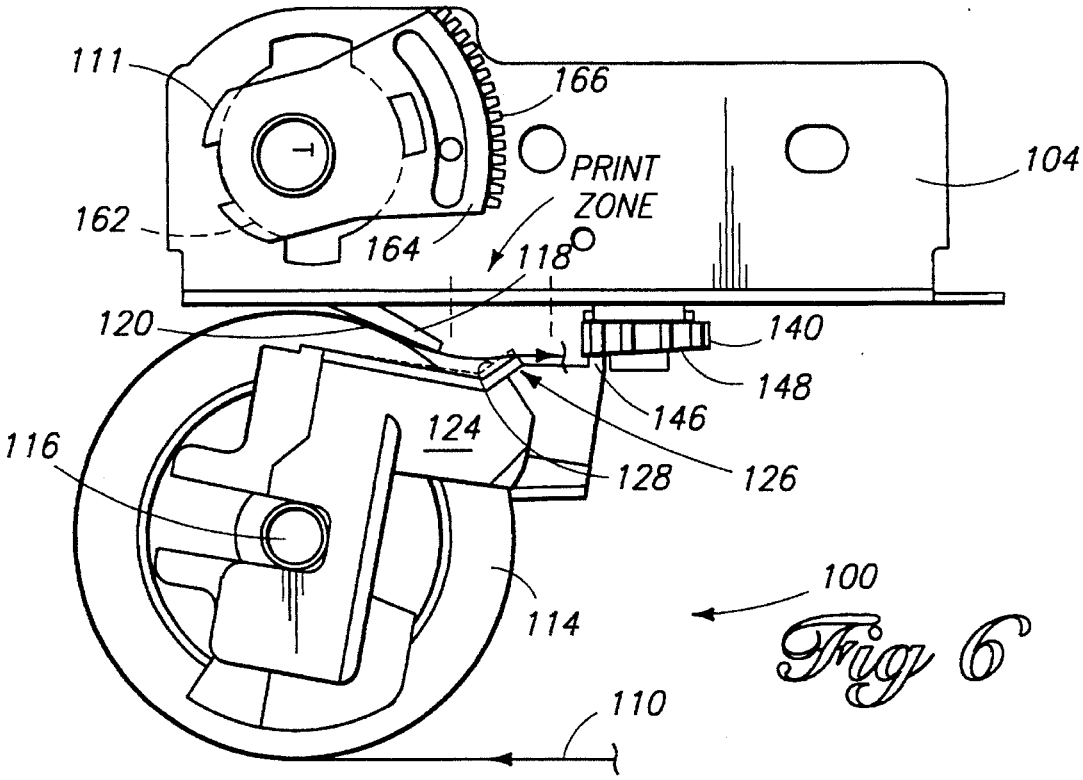
FIG. 6 is an enlarged diagrammatic side view of the print medium support mechanism shown in FIG. 3 configured in a second adjusted setting.
Figure 7:
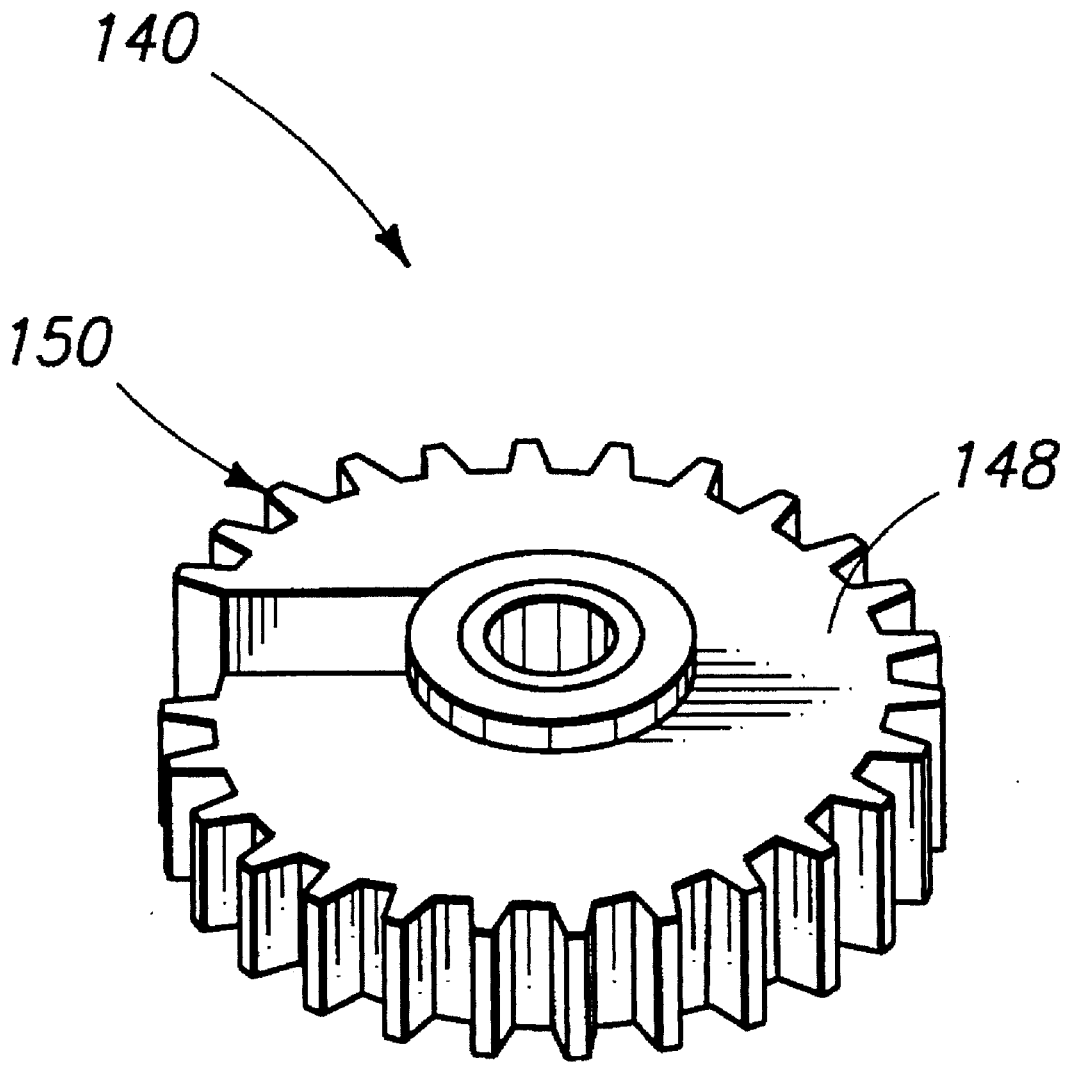
FIG. 7 is a bottom perspective view of an adjustable stop wheel in accordance with the preferred embodiment of the invention.

FIGS. 5 and 6 show different adjustments of both pivot 124 and carriage rod 111. In FIG. 5, pivot 124 is shown in a first non-retracted position and carriage rod 111 is shown in at a first elevation. In FIG. 6, cam wheel 140 has been rotated so that its thicker portion contacts abutment 146. This lowers lower support edge 130 from its position in FIG. 5. Bushing 160 has been rotated in FIG. 6 to lower carriage rod 111.

Providing the components described above allows precise and independent adjustment of both print medium shape and media-to-printhead spacing. In preferred methodical aspects of the invention, one step comprises vertically adjusting the upper and lower print media guides relative to each other to establish a desired print medium shape and angle through the print zone. An independent step comprises adjusting the vertical positioning of the printer's printhead relative to the upper and lower print media guides to set the printhead at a desired spacing from the paper without changing the print medium shape and angle established by the vertical adjustment of the upper and lower print media guides. A further step in accordance with the invention comprises adjusting a lower print media guide stop to set the vertical position of the lower print media guide relative to the upper print media guide when the lower print media guide is pivoted to its non-retracted position, and to thereby establish the desired print medium shape and angle. In the preferred embodiment, this is performed in an automated fashion by first measuring the print medium shape and angle in the print zone and by then moving or rotating a cam with an external actuator to bring the paper to the desired shape and angle.

The invention results in a number of advantages over the prior art. One significant advantage is that print medium shape and angle can be controlled independently of media-to-printhead spacing. This allows the establishment of a print medium shape designed to minimize bulging after ink application. The adjustment of the print medium shape and angle is performed using that part of the print medium support mechanism which has one of the largest positional errors affecting print medium shape-the pivot. Furthermore, adjusting the pivot after assembly eases the parts and assembly tolerances which would otherwise be required. The particular implementation of the invention allows the adjustment to be automated to reduce costs during assembly. The adjustment also eliminates end-user involvement in adjusting the print medium shape and position. The adjustment is completed once at the factory and requires no additional attention.

In compliance with the statute, the invention has been described in language more or less specific as to structural and methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A print medium support mechanism for supporting a sheetlike print medium in a print zone adjacent a printer's printhead, comprising:

at least one drive roller positioned upstream from the print zone of the printer to feed a sheetlike print medium into the print zone;

an upper print media guide between the drive roller and the print zone to contact and support the print medium from above;

a lower print media guide downstream from the upper print media guide to contact and support the print medium from below, the print medium having a shape and angle in the print zone which is established at least in part by the support of the upper and lower print media guides against opposite sides of the print medium;

the upper and lower print media guides being vertically adjustable relative to each other to establish a desired shape and angle through the print zone;

media-to-printhead spacing adjustment means for adjusting the vertical positioning of the printer's printhead relative to the upper and lower print media guides and for thereby setting the printhead at a desired spacing from the print medium without changing the print medium's shape and angle established by the relative adjustment of the upper and lower print media guides.

2. A print medium support mechanism as recited in claim 1 wherein the lower print media guide is movable between retracted and non-retracted positions relative to the print zone, the print medium support mechanism further comprising a stop for the lower print media guide when it is in its non-retracted position, said stop being adjustable to set the vertical position of the lower print media guide relative to the upper print media guide when the lower print media guide is in its non-retracted position, and to thereby establish the desired print medium shape and angle.

3. A print medium support mechanism as recited in claim 1 wherein the lower print media guide is movable between retracted and non-retracted positions relative to the print zone, the print medium support mechanism further comprising a stop for the lower print media guide when it is in its non-retracted position, said stop being adjustable to set the vertical position of the lower print media guide relative to the upper print media guide when the lower print media guide is in its non-retracted position, and to thereby establish the desired print medium shape and angle, said stop comprising a moveable cam of varying thickness.

4. A print medium support mechanism as recited in claim 1 wherein the lower print media guide is movable between retracted and non-retracted positions relative to the print zone, the print medium support mechanism further comprising a stop for the lower print media guide when it is in its non-retracted position, said stop being adjustable to set the vertical position of the lower print media guide relative to the upper print media guide when the lower print media guide is in its non-retracted position, and to thereby establish the desired print medium shape and angle, said stop comprising a rotatable cam wheel.

5. A print medium support mechanism as recited in claim 1 wherein the lower print media guide is movable between retracted and non-retracted positions relative to the print zone, the print medium support mechanism further comprising a stop for the lower print media guide when it is in its non-retracted position, said stop being adjustable to set the vertical position of the lower print media guide relative to the upper print media guide when the lower print media guide is in its non-retracted position, and to thereby establish the desired print medium shape and angle, said stop comprising a rotatable cam wheel, the rotatable cam wheel having gear teeth about its outer periphery to allow automated adjustment of the lower print media guide non-retracted positioning during manufacture of the print medium support mechanism.

6. A print medium support mechanism as recited in claim 1 wherein the media-to-printhead spacing adjustment means comprises a carriage rod and an associated eccentric bushing.

7. A print medium support mechanism for supporting a sheetlike print medium in a print zone adjacent a printer's printhead, comprising:

a drive roller shaft having a longitudinal axis;

at least one drive roller which rotates about the longitudinal axis of the drive roller shaft, the drive roller being positioned upstream from the print zone of the printer to feed a sheetlike print medium into the print zone;

an upper print media guide between the drive roller and the print zone to contact and support the print medium from above;

a lower print media guide mounted downstream from the upper print media guide to pivot about the drive roller shaft between retracted and non-retracted positions relative to the print zone, the lower print media guide being positioned when in its non-retracted position to contact and support the print medium from below, the print medium having a shape and angle in the print zone which is established at least in part by the support of the upper and lower print media guides against opposite sides of the print medium;

a lower print media guide stop for the lower print media guide when it is pivoted to its non-retracted position, the lower print media guide stop being adjustable to set the vertical position of the lower print media guide relative to the upper print media guide when the lower print media guide is pivoted to its non-retracted position, and to thereby set a desired shape and angle;

media-to-printhead spacing adjustment means for adjusting the vertical positioning of the printer's printhead relative to the upper and lower print media guides and for thereby setting the printhead at a desired spacing from the print medium without changing the print medium shape and angle established by the adjustment of the lower print media guide stop.

8. A print medium support mechanism as recited in claim 7 wherein the stop comprises a moveable cam of varying thickness.

9. A print medium support mechanism as recited in claim 7 wherein the stop comprises a rotatable cam wheel.

10. A print medium support mechanism as recited in claim 7 wherein the stop comprises a rotatable cam wheel, the rotatable cam wheel having gear teeth about its outer periphery to allow automated adjustment of the lower print media guide non-retracted positioning during manufacture of the print medium support mechanism.

11. A print medium support mechanism as recited in claim 7 wherein the media-to-printhead spacing adjustment means comprises a carriage rod and an associated eccentric bushing.

12. A print medium support mechanism as recited in claim 7 wherein the upper print media guide comprises a surface which inclines downwardly in the downstream direction to a low edge which contacts the print medium from above.

13. A print medium support mechanism as recited in claim 7 wherein the lower print media guide comprises a surface which inclines upwardly in the downstream direction to an upper support edge which contacts the print medium from below, the upper support edge being adjustable to an elevation above that of the upper print media guide to incline the print medium upwardly in the downstream direction through the print zone.

14. A print medium support mechanism as recited in claim 7 wherein:

the upper print media guide comprises a surface which inclines downwardly in the downstream direction to a low edge which contacts the print medium from above;

the lower print media guide comprises a surface which inclines upwardly in the downstream direction to an upper support edge which contacts the print medium from below;

the drive roller has an uppermost elevation; and both the low edge of upper print media guide and the upper support edge of the lower print media guide are below the uppermost elevation of the drive roller below, the upper support edge being adjustable to an elevation above that of the upper print media guide to incline the print medium upwardly in the downstream direction through the print zone.

15. A print medium support mechanism as recited in claim 7 wherein:

the stop comprises a rotatable cam wheel, the rotatable cam wheel having gear teeth about its outer periphery to allow automated adjustment of the lower print media guide non-retracted positioning during manufacture of the print medium support mechanism;

the upper print media guide comprises a surface which inclines downwardly in the downstream direction to a low edge which contacts the print medium from above;

the lower print media guide comprises a surface which inclines upwardly in the downstream direction to an upper support edge which contacts the print medium from below;

the drive roller has an uppermost elevation; and both the low edge of upper print media guide and the upper support edge of the lower print media guide are below the uppermost elevation of the drive roller.

16. A method for supporting a sheetlike print medium in a print zone adjacent a printer's printhead comprising the following steps:

positioning at least one drive roller upstream from the print zone of the printer to feed a sheetlike print medium into the print zone;

providing an upper print media guide adjacent the drive roller between the drive roller and the print zone to contact and support the print medium from above;

providing a lower print media guide downstream from the upper print media guide to contact and support the print medium from below, the print medium having a shape and angle in the print zone which is established at least in part by the support of the upper and lower print media guides against opposite sides of the print medium;

vertically adjusting the upper and lower print media guides relative to each other to establish a desired print medium shape and angle through the print zone;

adjusting the vertical positioning of the printer's printhead relative to the upper and lower print media guides to set the printhead at a desired spacing from the print medium without changing the print medium's shape and angle established by the vertical adjustment of the upper and lower print media guides.

17. A method as recited in claim 16 wherein the lower print media guide is pivotable between retracted and non-retracted positions relative to the print zone, the method further comprising:

providing a lower print media guide stop which the lower print media guide rests against when it is pivoted to its non-retracted position;

adjusting the lower print media guide stop to set the vertical position of the lower print media guide relative to the upper print media guide when the lower print media guide is pivoted to its non-retracted position, and to thereby establish the desired print medium shape and angle.

18. A method as recited in claim 16 wherein the lower print media guide is pivotable between retracted and non-retracted positions relative to the print zone, the method further comprising:

providing a lower print media guide stop which the lower print media guide rests against when it is pivoted to its non-retracted position, the lower print media guide stop comprising a movable cam of varying thickness;

moving the movable cam with an external actuator to set the vertical position of the lower print media guide relative to the upper print media guide when the lower print media guide is pivoted to its non-retracted position, and to thereby establish the desired print medium shape and angle.

19. A method as recited in claim 16 wherein the lower print media guide is pivotable between retracted and non-retracted positions relative to the print zone, the method further comprising:

providing a lower print media guide stop which the lower print media guide rests against when it is pivoted to its non-retracted position, the lower print media guide stop comprising a rotatable cam wheel of varying thickness with gear teeth about its outer periphery;

rotating the rotatable cam wheel with an external gear to set the vertical position of the lower print media guide relative to the upper print media guide when the lower print media guide is pivoted to its non-retracted position, and to thereby establish the desired print medium shape and angle.

20. A method as recited in claim 16 wherein the lower print media guide is pivotable between retracted and non-retracted positions relative to the print zone, the method further comprising:

providing a lower print media guide stop which the lower print media guide rests against when it is pivoted to its non-retracted position;

measuring the print medium's shape and angle in the print zone;

adjusting the lower print media guide stop in response to measuring the print medium's shape and angle to establish the desired print medium shape and angle during manufacture of a printer.

* * * * *